United States Patent [19]

LoBiondo

[11] 4,379,445

[45] Apr. 12, 1983

[54] RUBBER BAND RIFLE

[76] Inventor: Vincent LoBiondo, 8873 19th Ave., Brooklyn, N.Y. 11214

[21] Appl. No.: 245,425

[22] Filed: Mar. 19, 1981

[51] Int. Cl.[3] ..... F41B 7/00

[52] U.S. Cl. ..... 124/19

[58] Field of Search ..... 124/19, 18, 41 R, 35 R

[56] References Cited

U.S. PATENT DOCUMENTS

| | | | |
|---|---|---|---|
| 1,909,927 | 5/1933 | Beauchamp et al. | 124/19 |
| 2,098,001 | 11/1937 | Gagnon et al. | 124/19 |
| 2,576,248 | 11/1951 | Wright et al. | 124/19 |
| 2,625,147 | 1/1953 | Eagleson | 124/19 |
| 2,878,802 | 3/1959 | Kuch | 124/19 |
| 2,917,037 | 12/1959 | Henderson | 124/19 |
| 3,494,345 | 2/1970 | Griffiths | 124/19 |

FOREIGN PATENT DOCUMENTS

| | | | |
|---|---|---|---|
| 1159349 | 7/1969 | United Kingdom | 124/19 |

*Primary Examiner*—Richard C. Pinkham
*Assistant Examiner*—William R. Browne
*Attorney, Agent, or Firm*—Robert D. Farkas

[57] ABSTRACT

A rubber band rifle for shooting one or a plurality of rubber band members generally includes a body having a forward barrel portion and a rear shoulder portion having a plurality of horizontal grooves disposed therein, one end of each of the rubber band members being disposed in one of the horizontal grooves in the forward end wall, a slide mechanism being movably disposed on the forward barrel portion, the slide mechanism including a top and a pair of downwardly extending walls, an upper surface of the top of the slide mechanism having a plurality of notches therein, the other ends of the rubber bands being disposed in the notches, and a mechanism for locking the slide mechanism in a fixed position upon the barrel portion of the body.

3 Claims, 3 Drawing Figures

RUBBER BAND RIFLE

BACKGROUND OF THE INVENTION

1. The Field of the Invention

This invention relates to a rubber band rifle for shooting one or a plurality of rubber band members generally including a body having a forward barrel portion and a rear shoulder portion having a plurality of horizontal grooves disposed therein, one end of each of the rubber band members being disposed in one of the horizontal grooves in the forward end wall, a slide mechanism being movably disposed on the forward barrel portion, the slide mechanism including a top and a pair of downwardly extending walls, an upper surface of the top of the slide mechanism having a plurality of notches therein, the other ends of the rubber bands being disposed in the notches, and a mechanism for locking the slide mechanism in a fixed position upon the barrel portion of the body.

2. Description of the Prior Art

A number of U.S. Pat. Nos., namely 2,625,147; 2,878,802; 2,917,037; and 3,494,345; have been employed as rubber band guns, but are non-applicable to the instant invention, since they do not provide the improved mechanism of the instant invention which provides a means for varying the tension placed on the rubber band which is to be shot by the rubber band rifle.

U.S. Pat. No. 2,576,248 provides a repeating rubber band toy gun which has a trigger mechanism for releasing the rubber bands. U.S. Pat. No. 1,909,927 also describes a repeating rubber band rifle having an automatic release mechanism for shooting the rubber bands. Neither of these patents provide the improved slide mechanism of the instant invention which provides a means of varying the tension placed on the rubber bands.

SUMMARY OF THE INVENTION

The present invention relates to a unique and novel rubber band rifle capable of shooting one or a plurality of rubber band members, wherein a mechanism is provided for varying the tension placed on the rubber band members.

A primary object of the present invention is to provide a rubber band rifle of simple design and low manufacturing cost, wherein one or a plurality of rubber band members can be shot in rapid succession.

Another object of the present invention is to provide a mechanism whereby the tension placed on the rubber band members can be varied thereby providing a means for controlling the projection velocity of the rubber band members as well as the distance that the rubber band members will travel.

These objects as well as other objects of the present invention, will become more readily apparent after reading the following description of the accompanying drawings.

BRIEF DESCRIPTION OF THE DRAWINGS

The objects and features of the invention may be understood with reference to the following detailed description of an illustrative embodiment of the invention, taken together with the accompany drawings.

DESCRIPTION OF THE PREFERRED EMBODIMENT

Figure 1:
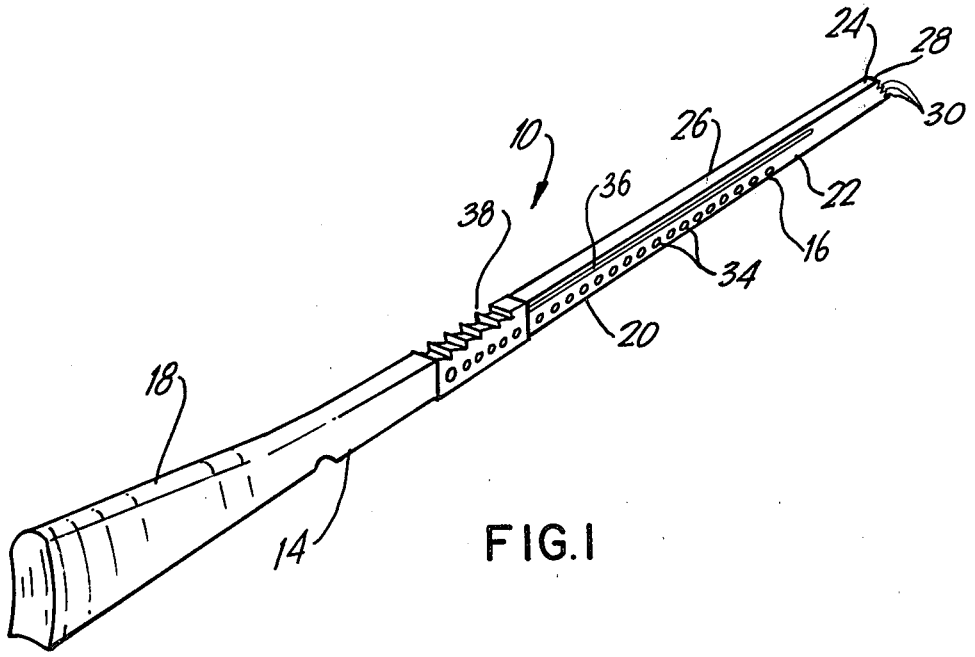
FIG. 1 illustrates a perspective view of the rubber band rifle.
Figure 2:
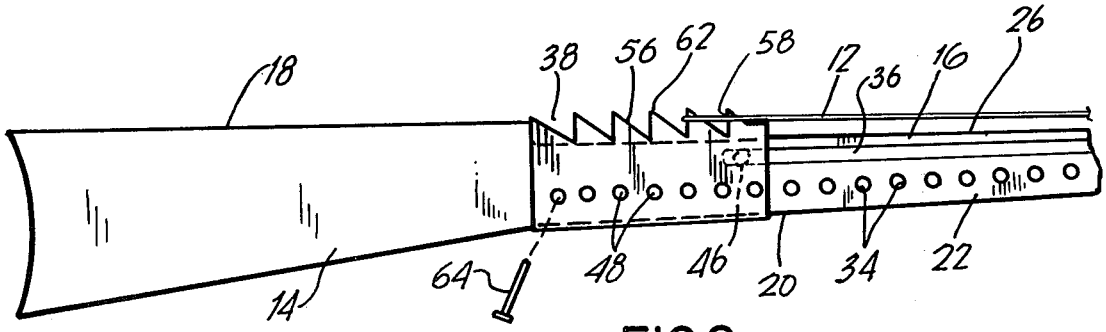
FIG. 2 illustrates a side view of the rubber band rifle.
Figure 3:
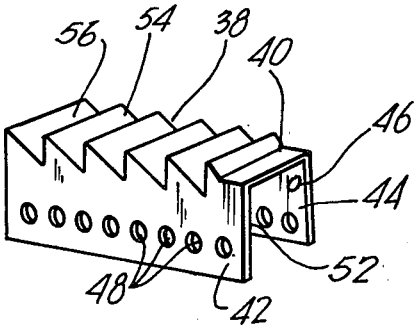
FIG. 3 illustrates a perspective view of the slide mechanism of the rubber band rifle.

Turning now decriptively to the drawings in which similar reference characters denote similar elements throughout the several views, FIGS. 1–3 show a rubber band rifle 10 which a capable of shooting a plurality of rubber band members 12 either simultaneously or in rapid succession. The rubber band rifle 10 broadly comprises a body 14 having a forward elongated barrel portion 16 and a rearwardly shoulder portion 18. The forward elongated barrel portion 16 comprises a bottom 20, a pair of upwardly extending planar sidewalls 22, and a top 26, a forward upwardly extending wall 28 at the muzzle end 30 of the forward elongated barrel portion 16, whereas the upwardly extending wall 28 has a plurality of horizontal grooves 30 disposed therein, wherein each groove 30 extends between the vertical side edges of the wall 28. The forward barrel portion 16 has a plurality of transverse openings 34 therethrough, wherein the plurality of openings 34 are longitudinally aligned from the juncture of the shoulder portion 18 and the forward elongated barrel portion 16 of the body 14 forwardly along the elongated barrel portion 16 towards the muzzle end 24 of the elongated barrel portion 16. Each sidewall 22 has an elongated, longitudinally aligned groove 36 disposed therein. A slide mechanism 38 is movably disposed on the elongated barrel portion 16, wherein the slide mechanism 38 has a top 40 with a pair of downwardly extending walls 42, 44. The top 40 of slide mechanism 38 slidably engages the top 26 of barrel portion 16 and the downwardly extending walls 42, 44 of slide mechanism 38 slidably engage the sidewalls 22, 24 of barrel portion 16. A boss 46 is disposed on the interior surface of each downwardly extending wall 42, 44 of the slide mechanism 38, wherein the bosses 46 are slidably disposed in the grooves 36 of the barrel portion 16. Each downwardly extending wall 42, 44 has a plurality of holes 48 therethrough, wherein the holes 48 are longitudinally aligned in a row from a rear end 50 to a forward end 52 of the slide mechanism 38. The top longitudinal surface 54 of the slide mechanism has a plurality of triangularly shaped notches 56 therein wherein the forward wall 58 of each notch 56 extends vertically upwardly and the rear wall 60 of each notch 56 slants upwardly and rearwardly to a top edge 62 which is also the top edge 62 of the forward wall 58 of the next most rearward notch 56. Holes 48 in the legs 42, 44 are aligned with the openings 34 in the barrel portion 16. As the slide mechanism 38 is moved forwardly and rearwardly in a longitudinal direction on the barrel portion 16, one set of holes 48 aligns with one of the openings 34. A pin member 64 is inserted through the aligned holes 48 and the opening 34 thereby locking the slide mechanism 38 in a fixed position on the barrel portion 16. A plurality of rubber band members 12 are stretched rearwardly between the muzzle end 24 of the elongated barrel portion 16, wherein one end of each rubber band member 12 is disposed in one of the grooves 30 in the upwardly extending wall 28 of the muzzle end 24 of barrel portion 16, and the other ends of rubber band members 12 are disposed one in each of the notches 56 of slide mechanism 38. By varying the position of slide mechanism 38 on barrel portion 16 of the rubber band rifle 10, the tension on the rubber band members 12 can be varied thereby directly determining the projecting velocity and the distance that the rubber band members 12 will be projected. In use, the user pushes one of rubber bands 12 upwardly from the rearwardmost notch 56 on slide mechanism 38 and over the top edge 62 thereby permitting the rubber band member 12 to be projected forwardly towards a target. The next rubber band member 12 is pushed upwardly from the next forwarded notch 56 and projected forwardly. The process is repeated until all the rubber band members 12 have been released from all the notches 56. The rearwardly slanted configuration of each forward wall 58 of each notch 56 prevents the rubber band members 12 from riding up and over the top edge 62 unless the user pushes the rubber band 12 upwardly and over the top edge 62.

One of the advantages of the present invention is a rubber band rifle of simple design and low manufacturing cost, wherein one or a plurality of rubber band members can be shot either simultaneously or in rapid succession.

Another advantage of the present invention is a mechanism whereby the tension placed on the rubber band members can be varied thereby providing a means for controlling the projection velocity of the rubber band members as well as the distance that the rubber band members will travel.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A rubber band rifle for shooting one or a plurality of rubber band members comprising a body having a forward barrel portion and a rear shoulder portion, a forward end wall of said barrel portion having a plurality of horizontal grooves disposed therein, one end of each of said rubber band members being disposed in one of said horizontal grooves in said forward end wall, a slide mechanism movably disposed on said forward barrel portion, said slide mechanism comprising a top and a pair of downwardly extending walls, an upper surface of said top of the slide mechanism having a plurality of notches disposed therein, each said rubber band members being stretched rearwardly from said forward extending wall of said barrel portion, wherein the other ends of said rubber band members being disposed in one of said notches, said forward barrel portion having a pair of sidewalls, each said sidewall having a longitudinally aligned groove therein and a boss disposed on the interior surface of each downwardly extending wall of said slide mechanism, each said boss being disposed in one of said longitudinally aligned grooves in said sidewalls of said barrel portion, means for locking said slide mechanism in a fixed position on said forward barrel portion, said locking mechanism comprises said barrel portion having a plurality of transverse holes therethrough, said holes being aligned in a longitudinal aligned row along said barrel portion, a plurality of openings through each downwardly extending wall of said slide mechanism, each set of said openings being aligned in a longitudinal row along each said downwardly extending wall of said slide mechanism, one of said holes being alignable with said openings, and a pin member, said pin member being insertable into said hole being aligned with said openings.

2. A rubber band rifle as claimed in claim 1 wherein each of said notches is triangularly shaped.

3. A rubber band rifle as claimed in claim 2 wherein each said notch further comprises a forward wall of each said notch slanting upwardly, a rearward wall of each said notch slanting upwardly and rearwardly to terminate in a top edge with the forward wall of said next most rearward notch.

* * * * *